US007841496B1

(12) United States Patent
Schweikert

(10) Patent No.: US 7,841,496 B1
(45) Date of Patent: Nov. 30, 2010

(54) SLING CLIP FOR CARRYING A RIFLE

(76) Inventor: Glen Schweikert, 115 Zayante Lake Rd., Felton, CA (US) 95018

( * ) Notice: Subject to any disclaimer, the term of this patent is extended or adjusted under 35 U.S.C. 154(b) by 0 days.

(21) Appl. No.: 10/957,997

(22) Filed: Oct. 4, 2004

(51) Int. Cl.
*F41C 33/00* (2006.01)
*F41C 23/02* (2006.01)

(52) U.S. Cl. ..... 224/150; 224/269; 224/913

(58) Field of Classification Search ..... 224/150, 224/268, 269, 913; 248/692, 213, 215, 322, 248/690; 24/2.5, 8, 65, 187, 189, 192, 199
See application file for complete search history.

(56) References Cited

U.S. PATENT DOCUMENTS

| | | | | | |
|---|---|---|---|---|---|
| RE6,474 | E | * | 6/1875 | Shendield | 24/192 |
| 180,992 | A | * | 8/1876 | Clinton et al. | 24/189 |
| 339,948 | A | * | 4/1886 | Spruce | 24/187 |
| 487,044 | A | * | 11/1892 | Ziegler | 24/187 |
| 919,301 | A | * | 4/1909 | Anderson | 224/149 |
| 1,602,091 | A | * | 10/1926 | Greeley | 24/659 |
| 1,690,694 | A | * | 11/1928 | Nissen | 24/199 |
| 1,718,291 | A | * | 6/1929 | Guenther | 24/199 |
| 2,652,050 | A | * | 9/1953 | Schoeller | 602/20 |
| 2,856,111 | A | * | 10/1958 | Wolfe et al. | 224/268 |
| 3,098,591 | A | * | 7/1963 | Lerude | 224/150 |
| 3,495,770 | A | * | 2/1970 | Rolling et al. | 224/150 |
| 4,331,271 | A | * | 5/1982 | Anderson | 224/150 |
| 4,431,122 | A | * | 2/1984 | Garmong | 224/268 |
| 4,542,840 | A | * | 9/1985 | Pepper et al. | 224/150 |
| 4,613,067 | A | * | 9/1986 | Gann | 224/150 |
| D330,633 | S | * | 11/1992 | Lavin | D3/221 |
| 5,564,610 | A | * | 10/1996 | Barron | 224/268 |
| D378,954 | S | * | 4/1997 | Daigle | D3/262 |
| 5,676,284 | A | * | 10/1997 | Schenberg | 223/1 |
| 6,260,748 | B1 | * | 7/2001 | Lindsey | 224/150 |
| 6,672,492 | B1 | * | 1/2004 | Thompson | 224/150 |
| 6,749,099 | B2 | * | 6/2004 | Danielson | 226/149 |
| 7,290,689 | B2 | * | 11/2007 | Oxley | 224/270 |
| 2002/0195472 | A1 | * | 12/2002 | Hickman | 224/247 |

* cited by examiner

*Primary Examiner*—Justin M Larson
(74) *Attorney, Agent, or Firm*—Michael A. Guth

(57) ABSTRACT

A plastic clip attaches to a gun sling, and assists in the carrying of a gun over the shoulder. The gun sling is an ordinary strap that attaches to the gun and loops over the shoulder. The clip attaches to the strap, and hooks into the waist belt. The clip allows the waist belt to support much of the weight of the gun, and keeps the gun from flopping around. The gun is further stabilized by a bungee cord that connects the clip to a belt loop.

2 Claims, 4 Drawing Sheets

SLING CLIP FOR CARRYING A RIFLE

BACKGROUND

This invention relates to straps and fasteners.

Hunters, soldiers, and others who have to carry a rifle often use a shoulder sling. The sling is a strap that holds a gun, usually a rifle or shotgun, and extends over the shoulder. The weight of the gun is supported by the shoulder, and the sling leaves the hands free.

Backpacks also commonly use shoulder straps to support a load. Because backpacks can be quite heavy, some backpacks have belts that go around the waist. A belt can support much of the weight of a backpack on the hips, as the hips can hold more weight than the shoulders.

A soldier might carry a gun and backpack, but he will usually not put the gun in the backpack. Most backpacks are not designed for the odd shape of a gun. Usually the soldier would rather carry the gun with a sling anyway, as it keeps the gun readily accessible for quick use when needed.

Carrying a gun with a simple sling has some disadvantages. The gun can flop around, and a hand is often needed to keep the gun in place. The sling can also put a strain on the shoulder if the gun is heavy or if on a long hike.

There is a need for a gun sling that is comfortable and convenient, and a need for something to keep the gun from flopping around. Any such product should also be cheap, reliable, sturdy, and weatherproof.

BRIEF SUMMARY OF THE INVENTION

The purpose of this device is to aid in the carriage of shoulder-strapped items, such as (but not restricted to) rifles, shotguns, cameras, purses, personal stereos, and guitars.

This device is used to relieve the weight from the shoulder of the user and transferring said weight to the waistline of the user by means of a clip or hook attached to the strap, or sling, or to the body itself or carrying case in which the carried item is contained, or carried by which clips or hooks upon user's belt, pants pocket, or pants waist.

By reducing the burden of weight upon the users shoulder and transferring this weight to the user's waistline, the user experiences less upper body fatigue, the carried item is stabilized by a line attachment to the body of user.

DETAILED DESCRIPTION OF THE INVENTION

In the preferred embodiment, the clip is made of some sort of plastic. The plastic can be any inexpensive and durable substance like nylon or polypropylene. The clip is manufactured using plastic injection molding equipment. Such plastics have the advantage that they are cheap, reliable, sturdy, and weatherproof. Alternatively, the clip can be made of metal, such as aluminum, titanium, or some alloy.

Figure 2:
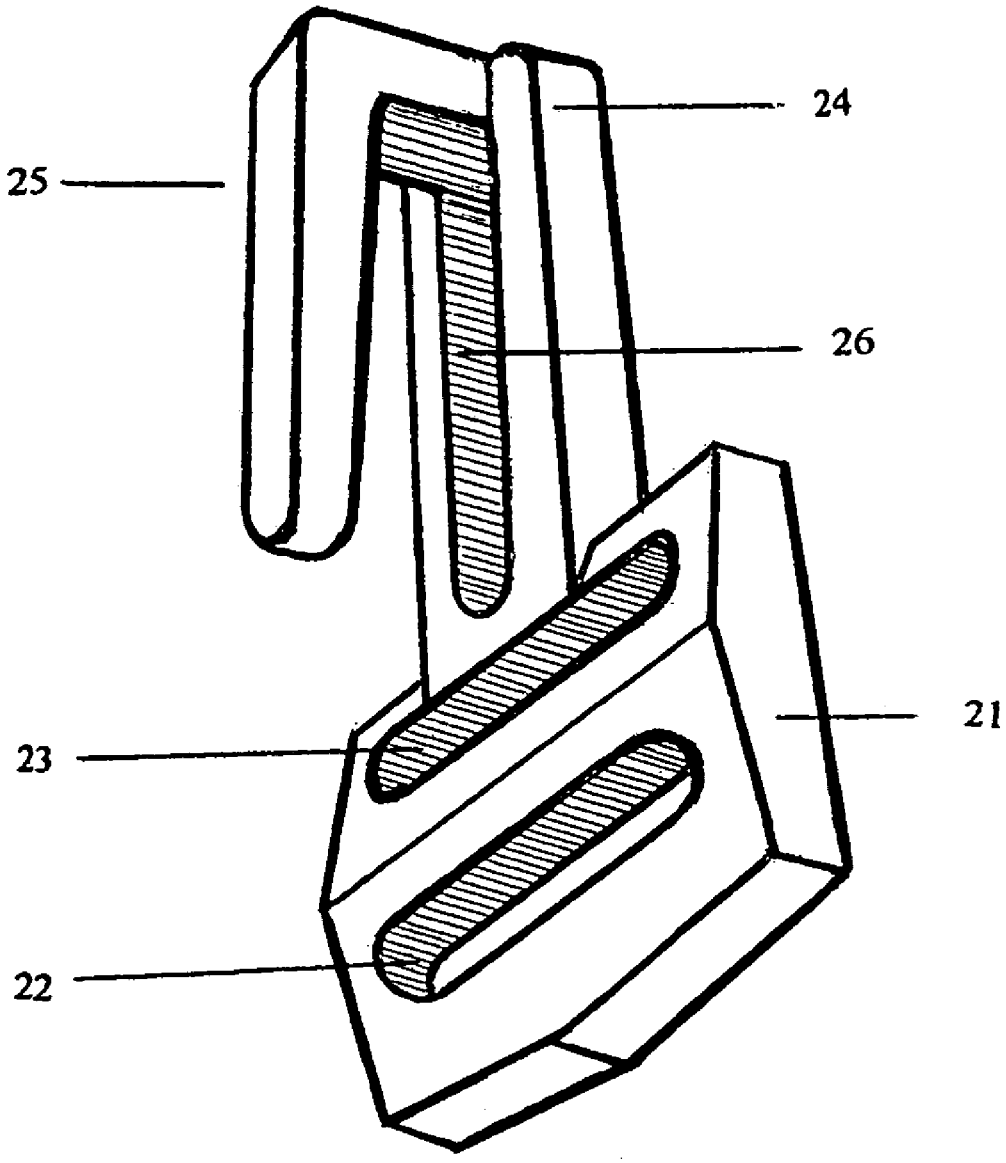
FIG. 2 shows a sling clip.

The clip in FIG. 2 is made of a solid piece of plastic. It has a slotted end 21 with slots 22 and 23. These slots can accommodate a strap or sling. The clip also has a hooked end 24 with a hook 25. A slot 26 underneath the hook 25 is also shown.

The slot 26 is not actually necessary for the function of the clip, but assists in the manufacture of the clip.

With the slot 26, the clip can be made with two-piece mold. Without the extra slot, the clip can be made with a three-piece mold.

The hook on the clip is simple, straight, and snag-free. A hunter or soldier may have to use his gun in a hurry, and the clip just slides off the belt when he pulls the gun up and forward.

Figure 1:
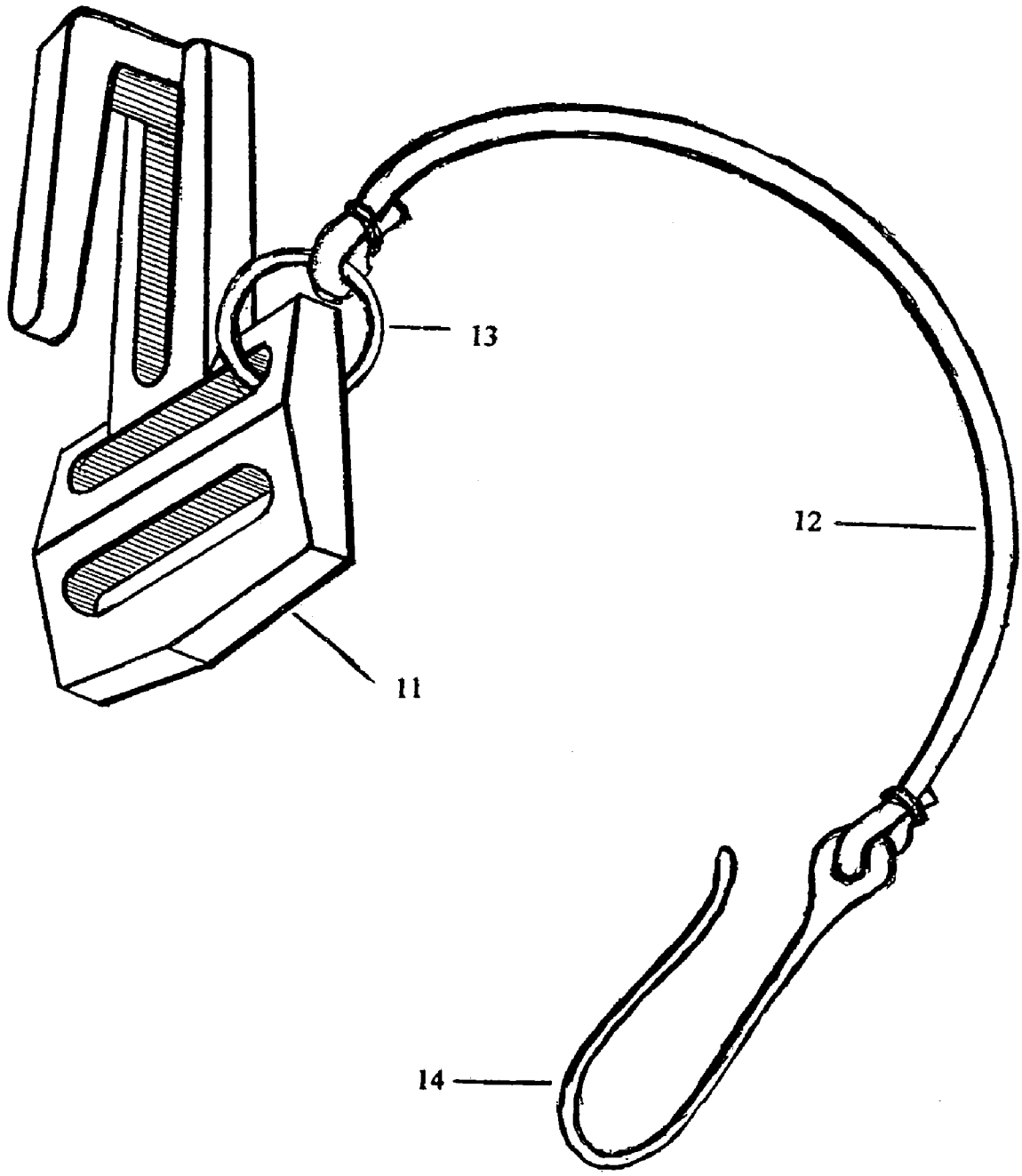
FIG. 1 shows a sling clip with a bungee cord and hook.

FIG. 1 shows the clip 11 of FIG. 1 with an attached bungee cord 12. The bungee cord 12 is attached to the clip's slotted end with a loop 13, and has a hook 14 at its other end.

Figure 3:
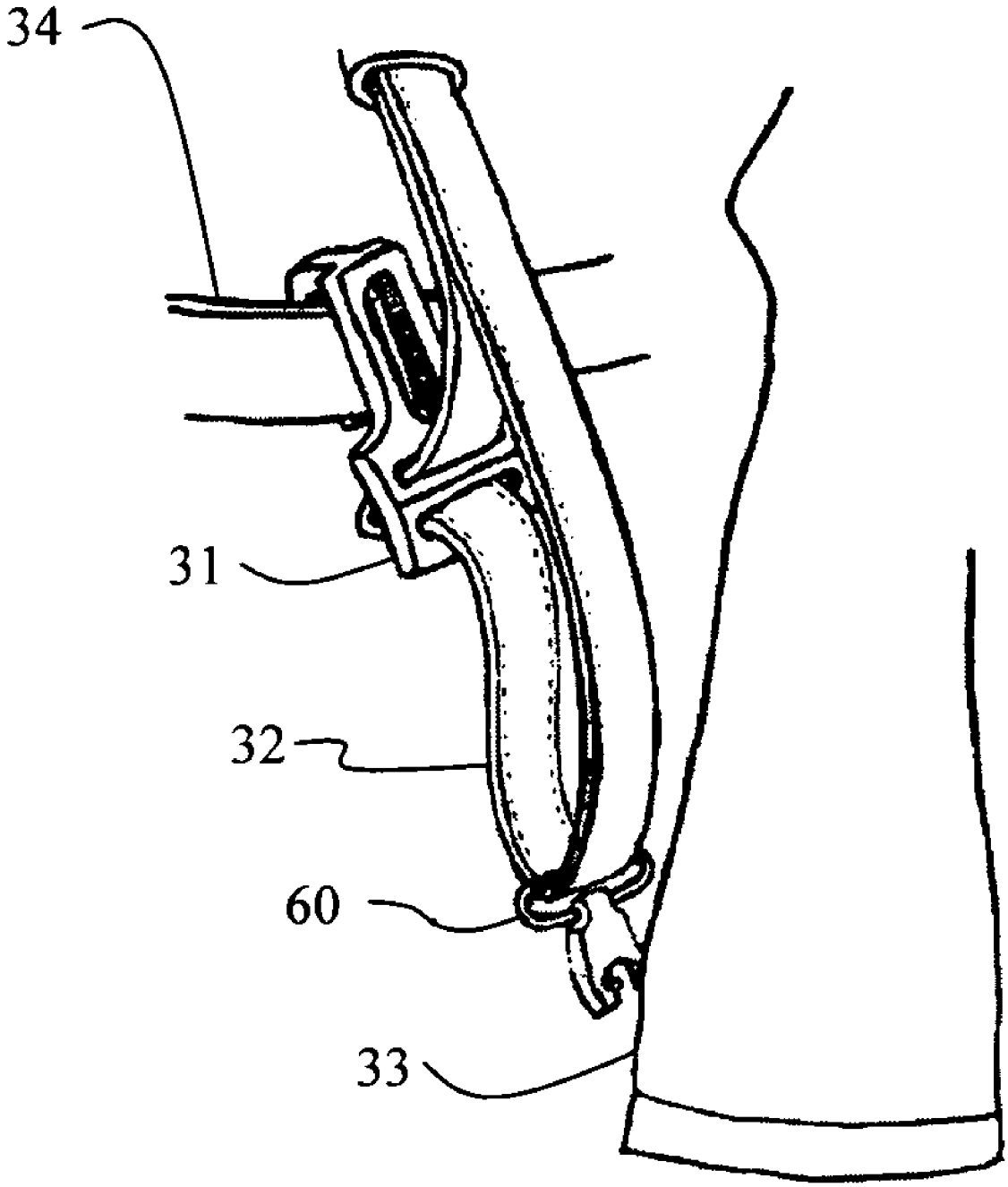
FIG. 3 shows a sling clip attached to a sling on a gun.

FIG. 3 shows the clip 31 of FIG. 1 attached to a sling 32. The sling 32 is attached to a rifle 33. The clip 31 is attached to belt 34.

Figure 4:
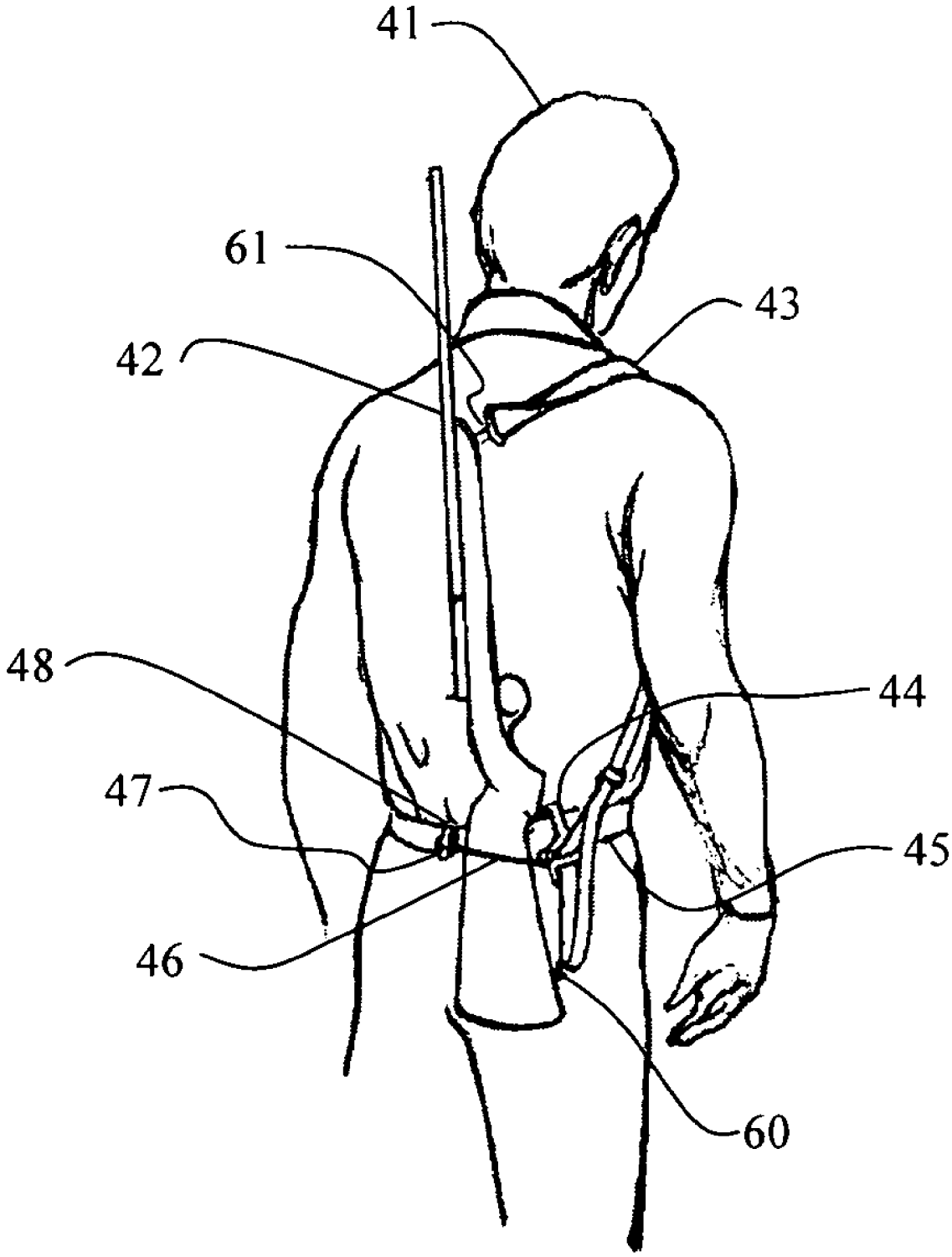
FIG. 4 shows a man carrying a gun, with sling on shoulder, clip on belt, and bungee cord.

FIG. 4 shows the invention as it might be used by a hunter. The hunter 41 is carrying a rifle 42 on his back with a sling 43 over his shoulder. The sling 43 is attached to a clip 44 and hooked onto his belt 45 in order to support much of the weight of the rifle 42. The rifle 42 is stabilized by a bungee cord 46 which is connected to the clip 44 and to a hook 47. The hook 47 is attached to a belt loop 48.

The bungee cord is an elasticized rope or rubber cord. Any cord can be used, but an elastic cord works best.

The belt can be an ordinary leather or fabric belt, or any convenient part of the man's clothing. For example, the clip could hook directly into the top of the man's pants, and the bungee cord could hook into the man's pocket, or backpack, or something else. Usually, the clip will hook into a waistband, which can be either a belt or the upper part of trousers that goes around the waist.

The man can carry the gun on a sling and clip by threading a sling through a clip, fastening the sling to the gun, putting the sling over his shoulder, hooking the clip to his belt or pants, and thereby support the gun on his belt and shoulder. The shoulder is partially supporting the weight, but the clip supports nearly all of the weight on the belt. When the clip and sling are adjusted properly, nearly all of the tension on the upper part of the sling is eliminated.

As seen in FIG. 4, the sling may be attached to the rifle using an attachment device 60, 61 at each end of the sling. The attachment devices 60, 61 may have a slot adapted to allow the strap to be run through the attachment device on one end. The attachment devices 60, 61 may be adapted to attach to the rifle on the other end.

While the invention has been described in terms of preferred embodiments, those skilled in the art will recognize that the invention can be practiced with modification within the spirit and scope of the appended claims.

I claim:

1. A sling and clip assembly comprising:

a clip, said clip comprising:

a slotted end, with two first slots that can accommodate a strap, said two first slots having a long direction and a narrow direction defining each of said slots, said two first slots parallel to each other along the long direction of said first two slots, said long direction of said first two slots defining a first axis; and a hooked end, with a hook, said hook curving around a second axis parallel to said first axis, suitable for hanging on a belt perpendicular to said strap, a sling, said sling comprising a first end and a second end and a straight strap portion running directly between said first end and said second end, each of said first end and said second end comprising an attachment device adapted to attach to a rifle, wherein said clip is attached to said sling along said straight strap portion through said two first slots, and wherein said second axis is perpendicular to said straight strap portion; and a non-weight-bearing substantially stretchable elastic cord, with one end of said elastic cord attached to said sling clip in vicinity of said slotted end; and with a hook on another end of said elastic cord, whereby said elastic cord can be used for lateral stability.

2. The assembly of claim 1 wherein said attachment device comprises a slot adapted to allow a portion of said sling to pass through the slot.

* * * * *